US011788333B2

(12) United States Patent
Au

(10) Patent No.: US 11,788,333 B2
(45) Date of Patent: Oct. 17, 2023

(54) HINGE STRUCTURE AND PACKAGING BOX WITH IT

(71) Applicant: Nationalpak Limited, Hong Kong (HK)

(72) Inventor: Ka Fai Kinsen Au, Hong Kong (HK)

(73) Assignee: Nationalpak Limited, Hong Kong (HK)

( * ) Notice: Subject to any disclaimer, the term of this patent is extended or adjusted under 35 U.S.C. 154(b) by 0 days.

(21) Appl. No.: 17/588,279

(22) Filed: Jan. 29, 2022

(65) Prior Publication Data

US 2022/0267057 A1 Aug. 25, 2022

(30) Foreign Application Priority Data

Feb. 25, 2021 (CN) ..... 202120431079.9

(51) Int. Cl.
*E05D 11/06* (2006.01)
*E05D 11/08* (2006.01)
*B65D 43/16* (2006.01)

(52) U.S. Cl.
CPC ..... *E05D 11/082* (2013.01); *B65D 43/166* (2013.01)

(58) Field of Classification Search
CPC ..... E05D 11/082; B65D 43/166
See application file for complete search history.

(56) References Cited

U.S. PATENT DOCUMENTS 156,325 A * 10/1874 Alston ..... E05D 7/081 126/105 R
309,039 A * 12/1884 Foster ..... E05F 1/063 16/316
612,471 A * 10/1898 Wood ..... E05F 1/063 16/318
897,002 A * 8/1908 Merritt ..... A47F 7/145 206/742
1,008,722 A * 11/1911 Kunz ..... A45C 9/00 312/200
1,294,044 A * 2/1919 Buckwalter et al. ..... E05D 11/1007 16/351
3,398,487 A * 8/1968 Matyas ..... E06B 3/72 16/312
3,538,539 A * 11/1970 Dale ..... E05D 5/14 16/375
3,905,065 A * 9/1975 Seeger ..... E05D 11/06 16/317

(Continued)

*Primary Examiner* — Jason W San

(57) ABSTRACT

The application provides a hinge structure comprising a first connecting piece provided with a slot and a second connecting piece provided with a rotating shaft. An inner wall of the slot is provided with a limiting slot and an outer surface of the rotating shaft is convex to form a clipping strip; the clipping strip is inserted into the limiting slot to limit a relative rotation angle between the first connecting piece and the second connecting piece. The present application also provides a packaging box comprising the above hinge structure. The hinge structure and the packing box are provided with a limiting slot in the slot and a clipping strip on the rotating shaft. Through the cooperation between the clipping strip and the limiting slot, the relative rotation angle between the first connecting piece and the second connecting piece is fixed and the reliability of the hinge structure is improved.

5 Claims, 5 Drawing Sheets

(56) References Cited

U.S. PATENT DOCUMENTS 4,501,045 A * 2/1985 Boyer ..... E05D 11/1078 16/376
4,697,306 A * 10/1987 Rhodes ..... E05F 1/063 256/26
5,287,596 A * 2/1994 Chen ..... E05D 11/06 16/376
5,765,263 A * 6/1998 Bolinas ..... E05D 11/105 16/342
6,353,967 B1 * 3/2002 Escobar ..... E05D 11/06 16/374
6,671,929 B1 * 1/2004 Lu ..... G06F 1/1616 16/374
7,945,996 B2 * 5/2011 Gunderson ..... E05F 1/063 16/303
7,974,666 B2 * 7/2011 Kosugi ..... H04M 1/0216 361/755
8,024,840 B2 * 9/2011 Shen ..... G06F 1/1681 16/303
8,060,985 B2 * 11/2011 Lin ..... G06F 1/1616 16/374
8,099,834 B2 * 1/2012 Corso ..... E05D 5/12 16/374
8,191,205 B2 * 6/2012 Forrest ..... E05D 5/14 16/386
8,307,513 B1 * 11/2012 Fitzgerald ..... E05D 11/06 16/386
8,646,154 B2 * 2/2014 Smith ..... E05D 11/1007 16/376
8,695,166 B2 * 4/2014 Wang ..... G06F 1/1681 16/337
8,739,366 B2 * 6/2014 Heninger ..... E05D 11/06 16/374
8,870,278 B2 * 10/2014 Tsai ..... E05D 3/02 108/115
9,068,382 B1 * 6/2015 Hall ..... E05D 5/12
9,206,633 B1 * 12/2015 Ju ..... G06F 1/1681
9,435,103 B2 * 9/2016 Lee ..... B60J 5/047
10,496,139 B2 * 12/2019 Huang ..... G06F 1/1656
10,890,023 B2 * 1/2021 Mccafferty ..... E05D 7/14
11,627,209 B2 * 4/2023 Määttä ..... B21D 53/40 16/342
2002/0144378 A1 * 10/2002 Liao ..... G06F 1/1681 16/342
2005/0011046 A1 * 1/2005 Dionysian ..... E05F 1/063 16/316
2005/0193522 A1 * 9/2005 Jackson ..... E05F 1/063 16/316
2005/0246863 A1 * 11/2005 Chesworth ..... E05D 7/081 16/221
2006/0117527 A1 * 6/2006 Tu ..... E05F 1/1016 16/303
2007/0094845 A1 * 5/2007 Chang ..... G06F 1/1616 16/342
2008/0271289 A1 * 11/2008 Hsu ..... G06F 1/1616 16/234
2010/0125977 A1 * 5/2010 Shen ..... G06F 1/1681 16/374
2011/0041290 A1 * 2/2011 Herglotz ..... E05D 3/06 16/375
2011/0154613 A1 * 6/2011 Chang ..... E05D 3/02 16/273
2011/0154615 A1 * 6/2011 Shen ..... H04M 1/0216 16/331
2012/0023704 A1 * 2/2012 Case ..... E05D 11/084 16/337
2013/0175264 A1 * 7/2013 Lin ..... G06F 1/1681 16/320
2014/0173852 A1 * 6/2014 Heninger ..... E05D 7/105 16/375
2014/0327350 A1 * 11/2014 Tassin ..... A47B 46/00 312/249.7
2016/0220007 A1 * 8/2016 Montoli ..... B65D 43/166

* cited by examiner

HINGE STRUCTURE AND PACKAGING BOX WITH IT

CROSS REFERENCE TO RELATED APPLICATIONS

The present claims the benefit of Chinese Patent Application No. 202120431079.9 filed on Feb. 25, 2021, the contents of which are incorporated herein by reference in their entirety.

TECHNICAL FIELD

The present application relates to the technical field of hinges, and more specially relates to a hinge structure and a packaging box with it.

BACKGROUND

Hinge is a mechanical device used to connect two objects and allow relative rotation between them. It can be applied to doors and windows or covered devices, such as installed on the packaging box to realize the opening and closing of the packaging box cover. However, the structure of the traditional hinge device is mostly complex, including multiple parts, which increases the production cost of the hinge. In addition, the traditional hinge lacks a positioning mechanism, and the rotation angle between the two objects connected by the hinge is difficult to be fixed. It is easy to have problems such as object damage caused by the collision between the object and the external object or the failure of the hinge due to excessive force of the object, which shortens the service life of the hinge and brings inconvenience to the use of the two objects connected by the hinge.

SUMMARY

Based on this, it is necessary to provide a hinge structure and a packaging box with a simple structure and a limited rotation angle in view of the technical problem that the structure is complicated and the relative rotation angle of two objects connected by a hinge is not easily fixed.

The present application provides a hinge structure and the hinge structure comprises a first connecting piece provided with a slot and a second connecting piece provided with a rotating shaft that matches the slot, the second connecting piece rotates relative to the first connecting piece when the rotating shaft is inserted into the slot and subjected to external force;

an inner wall of the slot is provided with a limiting slot and an outer surface of the rotating shaft is convex to form a clipping strip; the clipping strip is inserted into the limiting slot to limit a relative rotation angle between the first connecting piece and the second connecting piece when the rotating shaft is inserted into the slot and rotates relative to the first connecting piece.

In one embodiment, an outer surface contour of the clipping strip matches with an inner surface contour of the limiting slot.

In one embodiment, the limiting slot extends along a depth direction of the slot, and the clipping strip extends along a length direction of the rotating shaft.

In one embodiment, the outer surface of the rotating shaft is provided with two clipping strips in parallel, the inner wall of the slot is provided with at least one set of limiting slots, and each set of the limiting slots comprises two limiting slots which are matched with the two clipping strips one by one.

In one embodiment, the first connecting piece comprises a first connecting column provided with the slot and a first connecting part integrally formed with an outer surface of the first connecting column;

the second connecting piece comprises a second connecting column and a second connecting part integrally formed with an outer surface of the second connecting column, the rotating shaft is arranged in the middle of the second connecting column along an axial direction of the second connecting column.

In one embodiment, an end face of the first connecting column protrudes at an edge of the slot to form a first sector-annular convex portion, an end face of the second connecting column is recessed to form a second sector-annular recessed portion half surrounding the rotating shaft; when the rotating shaft is inserted into the slot the first sector-annular convex portion is inserted into the second sector-annular recessed portion, and can rotate in the second sector-annular recessed portion to limit a rotation angle range between the first connecting piece and the second connecting piece.

In one embodiment, the first connecting part is provided with a first recessed portion that is rotatably matched with the outer surface of the second connecting column, and the second connecting part is provided with a second recessed portion that is rotatably matched with the outer surface of the first connecting column.

In one embodiment, a circumferential angle corresponding to the first sector-annular convex portion is between 90° and 120°, and a circumferential angle corresponding to the second sector-annular recessed portion is between 180° and 270°.

The present application also provides a packaging box, and the packaging box comprises the above hinge structure, the packaging box further comprises a face cover and a bottom cover, and the face cover is connected with the bottom cover through the hinge structure.

In one embodiment, the face cover is provided with a face cover slot, the bottom cover is provided with a bottom cover slot; the first connecting part is inserted into the face cover slot and is fixedly connected with the face cover, and the second connecting part is inserted into the bottom cover slot and is fixedly connected with the bottom cover.

In the hinge structure and the packaging box provided by the present application, by the limiting slot arranged in the slot and the clipping strip arranged on the rotating shaft which is matched with the limiting slot, when the rotating shaft of the second connecting piece is inserted into the slot and the second connecting piece or/and the first connecting piece are subjected to an external deflection force, causing the first connecting piece to rotate relative to the second connecting piece, clipping strip slides along the inner wall of the slot until it is embedded in the limiting slot. In this way, the clipping strip is not easy to fall off from the limiting slot under the restriction of the limiting slot, so as to fix the relative rotation angle between the first connecting piece and the second connecting piece. On the contrary, when it is necessary to change the relative position of two objects connected through the hinge structure, only the first connecting piece or/and the second connecting piece only needs to be buckled with force from the opposite side, that is, the clipping strip leaves from the limiting slot, so as to facilitate the relative rotation of the first connecting piece and second connecting piece to adjust the relative rotation angle between them. The hinge structure involves few parts and has a simple structure. The relative rotation angle between the first connecting piece and the second connecting piece can be fixed, so as to avoid the damage of the connecting piece or the failure of the hinge structure caused by the excessively large relative rotation angle, so as to improve the market competitiveness of the hinge structure.

DETAILED DESCRIPTION OF THE PREFERRED EMBODIMENT

In order to make the above purpose, features and advantages of the present application more obvious and easy to understand, the specific embodiment of the present application is described in detail below in combination with the attached drawings. Many specific details are described in the following description to facilitate a full understanding of the present application. However, the present application can be implemented in many ways different from those described herein. Those skilled in the art can make similar improvements without violating the connotation of the present application. Therefore, the present application is not limited by the specific embodiments disclosed below.

Figure 1:
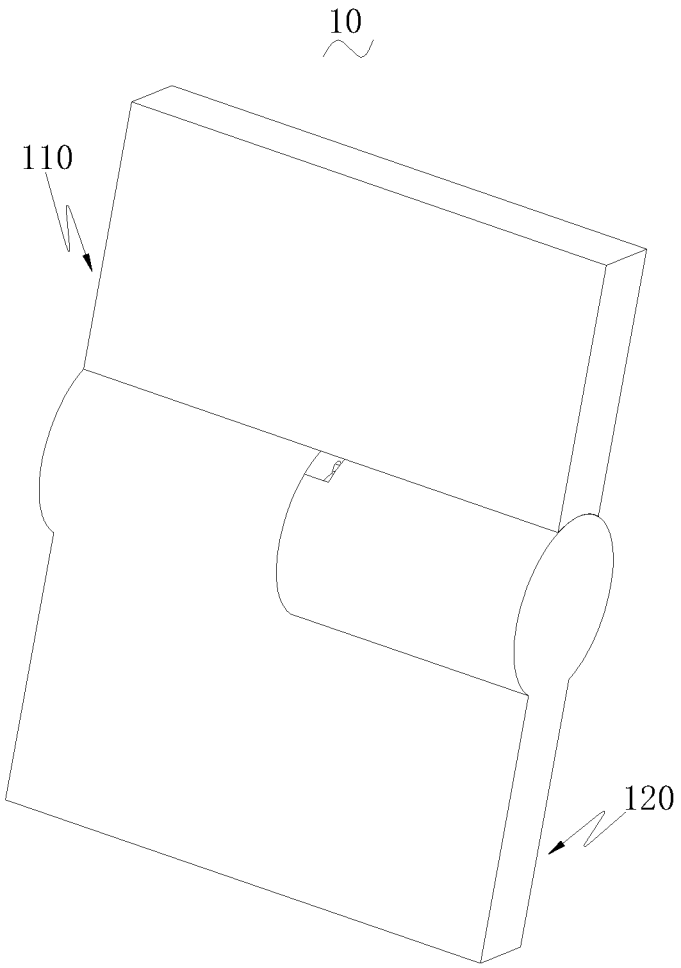
FIG. 1 is a schematic diagram of a hinge structure in one embodiment of the present application.
Figure 2:
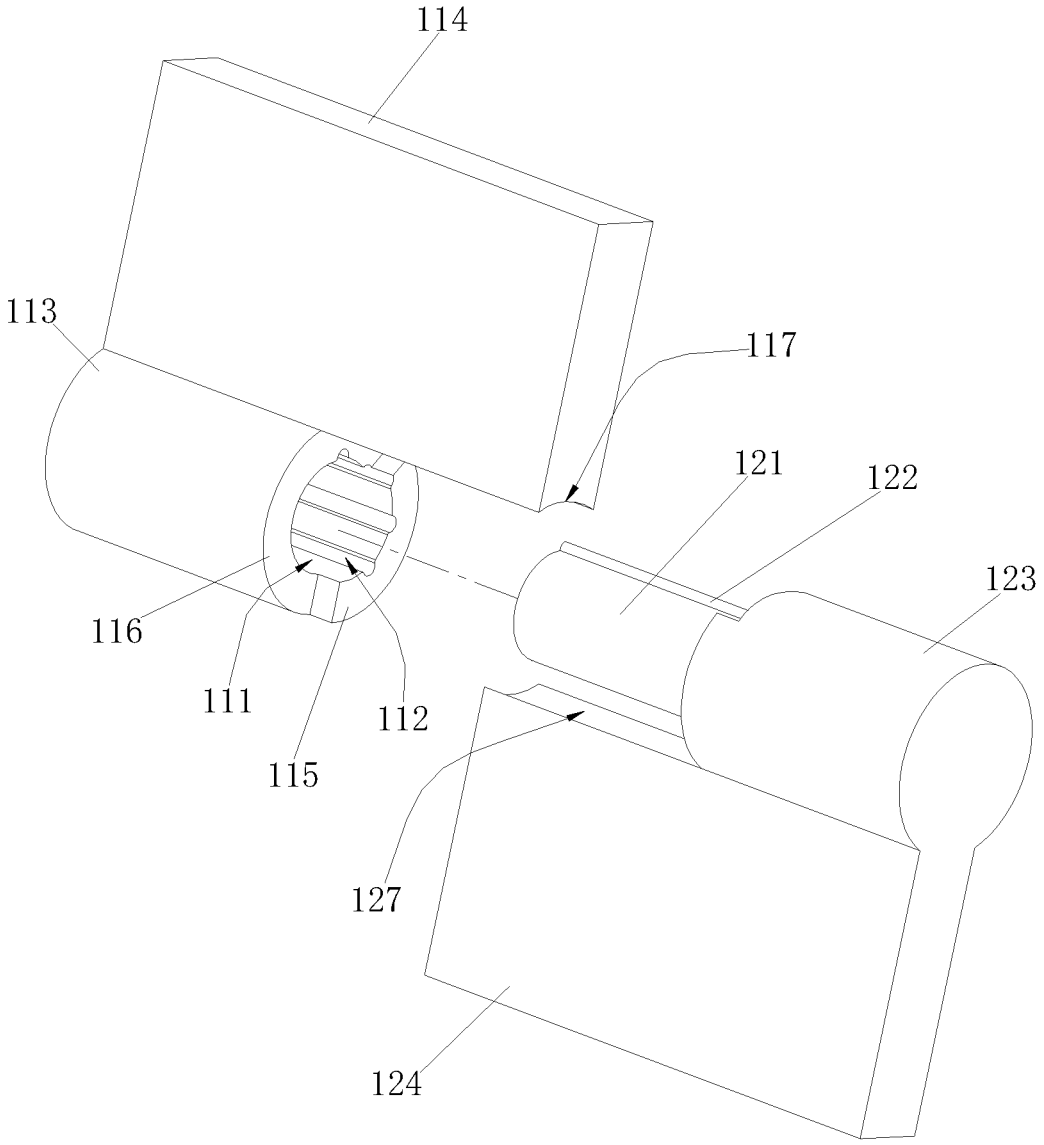
FIG. 2 is a schematic diagram of the explosion structure of the hinge structure in the embodiment shown in FIG. 1.

Please refer to FIG. 1 and FIG. 2 together, the present application provides a hinge structure 10 which has simple structure and can limit the rotation angle. The hinge structure 10 comprises a first connecting piece 110 and a second connecting piece 120, wherein, the first connecting piece 110 is for fixing to an external object, and the second connecting piece 120 is for fixing to another external object. The first connecting piece 110 is rotationally connected with the second connecting piece 120 to realize the relative rotation of the two objects. Specially, the first connecting piece 110 is provided with a slot 111, and the second connecting piece 120 is provided with a rotating shaft 121 matched with the slot 111. The second connecting piece 120 rotates relative to the first connecting piece 110 when the rotating shaft 121 is inserted into the slot 111 and subjected to external force. An inner wall of the slot 111 is provided with a limiting slot 112 and an outer surface of the rotating shaft 121 is convex to form a clipping strip 122; the clipping strip 122 is inserted into the limiting slot 112 to limit a relative rotation angle between the first connecting piece 110 and the second connecting piece 120 when the rotating shaft 121 is inserted into the slot 111 and rotates relative to the first connecting piece 110.

Figure 3:
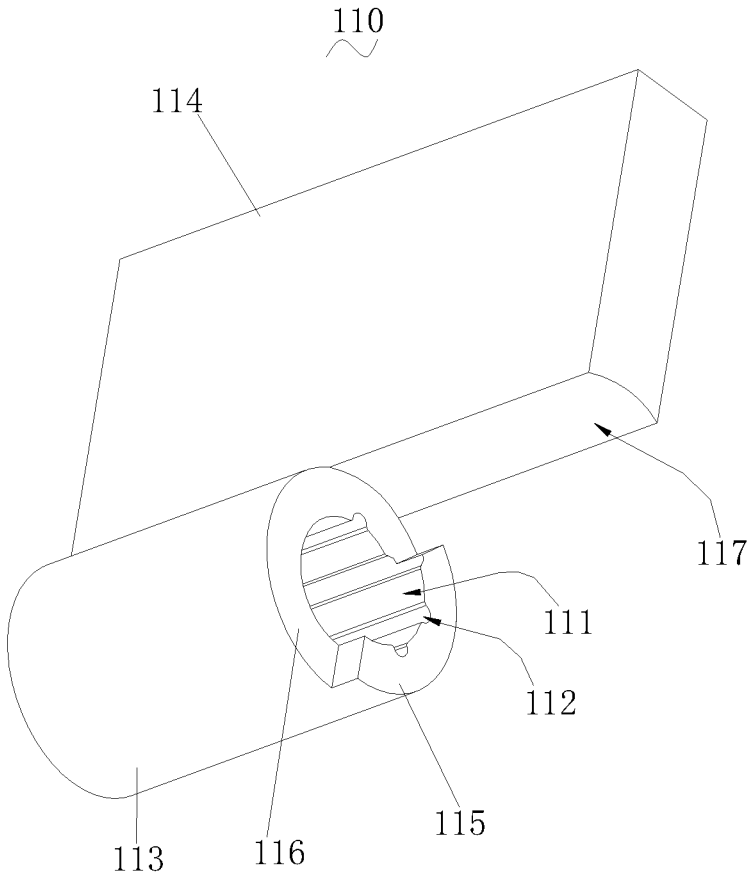
FIG. 3 is a structural diagram of the first connecting piece in an embodiment of the present application.
Figure 4:
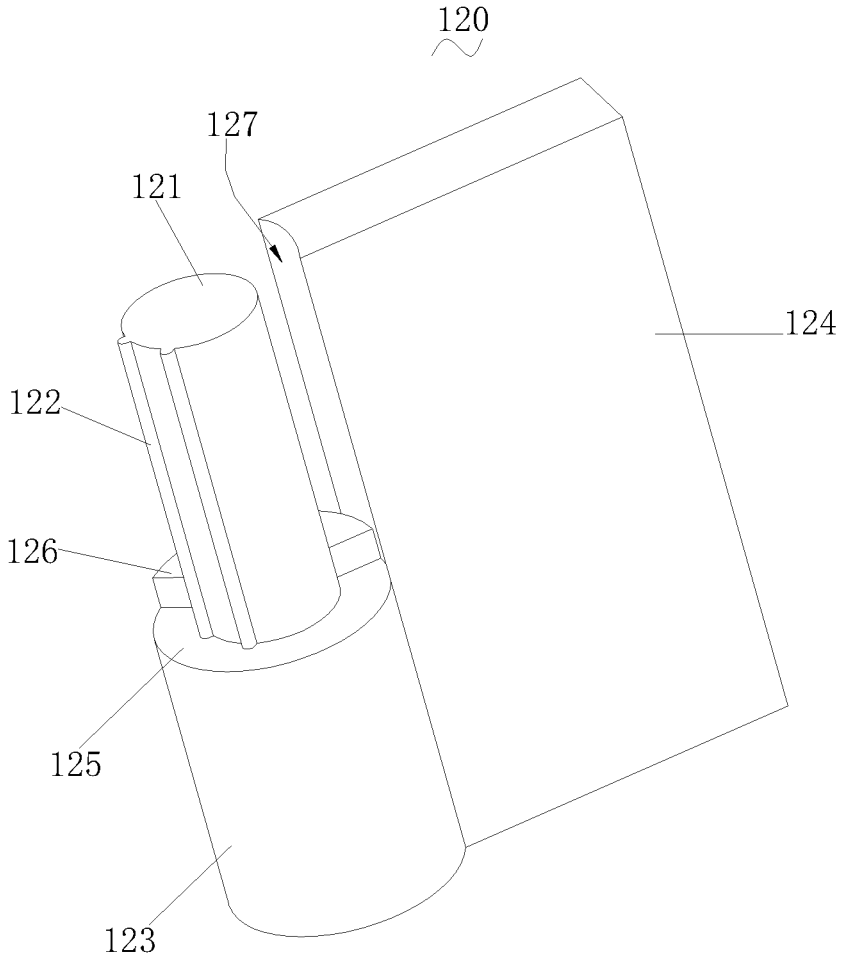
FIG. 4 is a structural diagram of the second connecting piece in an embodiment of the present application.

Please refer to FIGS. 2, 3 and 4 together. In one embodiment, an outer surface contour of the clipping strip 122 matches with an inner surface contour of the limiting slot 112. Preferably, the outer surface of the clipping strip 122 is a circular arc surface, the limiting slot 112 is an arc groove butting with the arc surface, and the transition part between the arc groove and the inner wall surface of the slot 111 is provided with an arc transition part to reduce the wear of the clipping strip 122 by the transition part between the arc groove and the inner wall surface of the slot 111, so as to prolong the service life of the clipping strip 122, and ensure the reliability of the clipping strip 122 and the limiting slot 112 for the corner fixing operation of the hinge structure 10.

Further, in one embodiment, the limiting slot 112 extends along a depth direction of the slot 111, and the clipping strip 122 extends along a length direction of the rotating shaft 121. That is, the limiting slot 112 is a straight slot whose length direction is perpendicular to any cross section of the slot 111, and the clipping strip 122 is a long strip-shaped protrusion corresponding to the shape of the straight slot. In another embodiment, the limiting slot 112 is a spiral slot opened along the inner wall surface of the slot 111, that is, while the limiting slot 112 extends along the depth direction of the slot 111, it also extends along the circumferential direction of the inner wall surface of the slot 111. The clipping strip 122 is a spiral protrusion arranged on the outer surface of the rotating shaft 121 and matched with the limiting slot 112. Of course, if the processing conditions permit, the limiting slot 112 can also be divided into a plurality of relatively independent sub slots. Similarly, the clipping strip 122 is designed as a plurality of clipping strips distributed at intervals along the outer surface of the rotating shaft 121. The specific requirements are determined according to the actual needs of the user, which will not be repeated here.

It should be noted that in one embodiment, the height of the clipping strip 122 along the radial direction of the rotating shaft 121 should be slightly less than or equal to the difference between the inner diameter of the slot 111 and the diameter of the rotating shaft 121. In this way, ensuring that before the clipping strip 122 is not embedded in the limiting slot 112, the rotating shaft 121 can rotate freely in the slot 111, while avoiding the possibility that the clipping strip 122 may be separated from the limiting slot 112 by external impact after being embedded in the limiting slot 112 due to the large movable space of the rotating shaft 121 in the slot 111, so as to improve the stability of the cooperation between the clipping strip 122 and the limiting slot 112 and the reliability of the relative corner fixing operation of the first connecting piece 110 and the second connecting piece 120.

In one embodiment, the outer surface of the rotating shaft 121 is provided with two clipping strips 122 in parallel, the inner wall of the slot 111 is provided with at least one set of limiting slots 112, and each set of the limiting slots 112 comprises two limiting slots 112 which are matched with the two clipping strips 122 one by one. Specifically, when the first connecting piece 110 rotates to a specified angle relative to the second connecting piece 120 and the relative angle between them needs to be fixed, the second connecting piece 120 is limited and matched with the two limiting slots 112 in the slot 111 of the first connecting piece 110 through two clipping strips 122, that is, one clipping strip 122 is correspondingly embedded into one limiting slot 112. In this way, the limit fit area between the first connecting piece 110 and the second connecting piece 120 is increased, and the stability of the connection between the first connecting piece 110 and the second connecting piece 120 is improved. After the first connecting piece 110 and the second connecting piece 120 rotate relative to each other to a specified angle, it is not easy to produce relative shaking, so as that the relative rotation angle between the first connecting piece 110 and the second connecting piece 120 can be fixed. In addition, by setting a plurality of sets of limiting slots 112, when the first connecting piece 110 and the second connecting piece 120 rotate at a plurality of different angles, the clipping strip 122 can be embedded in the limiting slots 112 at different positions and butted with the inner surface of the limiting slot 112, so as to fix a plurality of relative rotation angles between the first connecting piece 110 and the second connecting piece 120.

Please refer to FIGS. 3 and 4 together. In one embodiment, the first connecting piece 110 comprises a first connecting column 113 provided with the slot 111 and a first connecting part 114 integrally formed with an outer surface of the first connecting column 113; the second connecting piece 120 comprises a second connecting column 123 and a second connecting part 124 integrally formed with an outer surface of the second connecting column, the rotating shaft is arranged in the middle of the second connecting column 123 along an axial direction of the second connecting column 123. The first connecting part 114 and the second connecting part 124 are respectively used to connect with the external object to be limited. Preferably, the first connecting part 114 and the second connecting part 124 are plate-shaped structures respectively, and the height of the first connecting part 114 along the axial direction of the first connecting column 113 is equal to the height of the second connecting part 124 along the axial direction of the second connecting column 123, and the sum of the heights of the first connecting column 113 and the second connecting column 123 is equal to the height of the first connecting part 114 along the axial direction of the first connecting column 113. The length of the rotating shaft 121 is less than or equal to the depth of the slot 111.

In one embodiment, an end face of the first connecting column 113 protrudes at an edge of the slot 111 to form a first sector-annular convex portion 115, an end face of the second connecting column 123 is recessed to form a second sector-annular recessed portion 125 half surrounding the rotating shaft 121; when the rotating shaft 121 is inserted into the slot 111 the first sector-annular convex portion 115 is inserted into the second sector-annular recessed portion 125, and can rotate in the second sector-annular recessed portion 125 to limit a rotation angle range between the first connecting piece 110 and the second connecting piece 120. It should be noted that while the end face of the first connecting column 113 bulges at the edge of the slot 111 to form the first sector-annular convex portion 115, the end face of the first connecting column 113 naturally forms a low position with a height lower than the first sector-annular convex portion 115. The low position is the first sector-annular recessed portion 116, and the first sector-annular recessed portion 116 forms a complete ring with the first sector-annular convex portion 115. Similarly, while the end face of the second connecting column 123 is recessed to form a second sector-annular recessed portion 125 that half surrounds the rotating shaft 121, the end face of the second connecting column 123 naturally forms a high position higher than the first sector-annular convex portion 115. It is agreed that the high position is the second sector-annular convex portion 126, and the second sector-annular recessed portion 125 forms another complete ring with the second sector-annular convex portion 126. Thus, after the rotating shaft 121 of the second connecting piece 120 is inserted into the slot 111 of the first connecting piece 110, the first sector-annular convex portion 115 is embedded into the second sector-annular recessed portion 125, and the second sector-annular convex portion 126 is embedded into the first sector-annular recessed portion 116, that is, the end face of the first connecting column 113 is concave convex matched with the end face of the second connecting column 123.

Further, in one embodiment, a circumferential angle corresponding to the first sector-annular convex portion is between 90° and 120°, and a circumferential angle corresponding to the second sector-annular recessed portion is between 180° and 270°. The circumferential angle corresponding to the first sector-annular recessed portion 116 is between 240° and 270°, the circumferential angle corresponding to the second sector-annular convex portion 126 is between 90° and 180°. Thus, when the first sector-annular convex portion 115 is embedded in the second sector-annular recessed portion 125 and the second sector-annular convex portion 126 is embedded in the first sector-annular recessed portion 116, the first connecting piece 110 can only rotate relative to the second connecting piece 120 within the difference angle between the circumferential angle corresponding to the first sector-annular convex portion 115 and the circumferential angle corresponding to the second sector-annular recessed 125, or rotate relative to the second connecting piece 120 within the difference angle range between the circumferential angle corresponding to the second sector-annular convex portion 126 and the circumferential angle corresponding to the first sector-annular recessed 116, and the specific difference is subject to the smaller difference. Thus, the maximum rotation angle range between the first connecting piece 110 and the second connecting piece 120 is limited to avoid the problem of excessive external load on the hinge structure 10 due to the excessive relative rotation angle between the first connecting piece 110 and the second connecting piece 120, so as to prolong the service life of the hinge structure 10.

In one embodiment, the first connecting part 114 is provided with a first recessed portion 117 that is rotatably matched with the outer surface of the second connecting column 123, and the second connecting part 124 is provided with a second recessed portion 127 that is rotatably matched with the outer surface of the first connecting column 113. In this way, when the first connecting piece 110 is inserted into the slot 111 through the rotating shaft 121 and rotates relative to the second connecting piece 120, the first recessed portion 117 is adjacent or attached to the outer surface of the second connecting column 123 to restrict their relative movement in the radial direction of the second connecting column 123, and the second recessed portion 127 is adjacent or attached to the outer surface of the first connecting column 113 to restrict their relative movement in the radial direction of the first connecting column 113. Thus, the stability of the hinge structure 10 is further improved.

Figure 5:
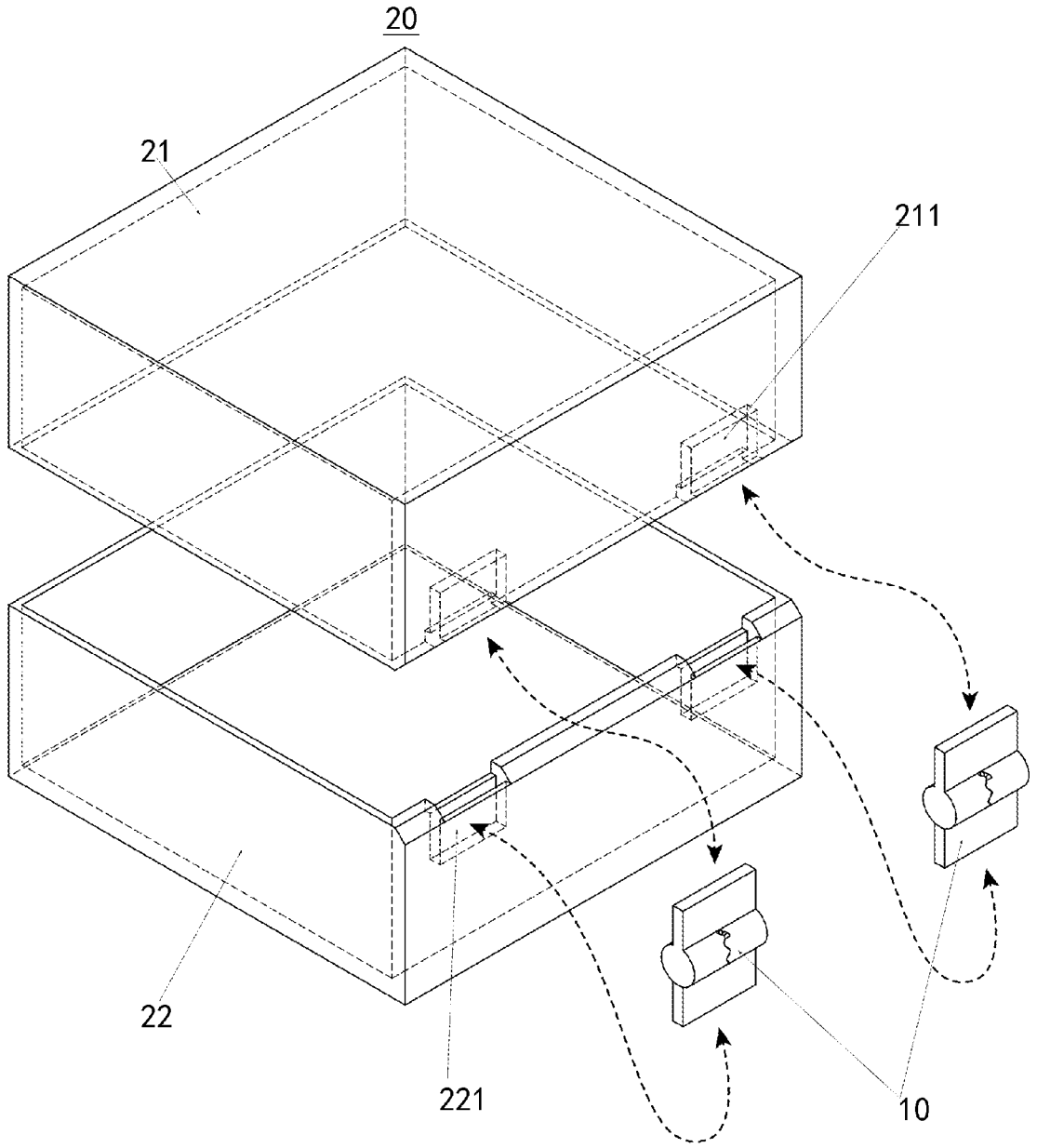
FIG. 5 is a structural diagram of a packaging box in an embodiment of the present application.

Please refer to FIG. 5, the present application also provides a packaging box 20. The packaging box 20 comprises the above hinge structure 10. The packaging box 20 further comprises a face cover 210 and a bottom cover 220, and the face cover 210 is connected with the bottom cover 220 through the hinge structure 10. Further, the face cover 210 is provided with a face cover slot 211, the bottom cover 220 is provided with a bottom cover slot 221; the first connecting part 114 is inserted into the face cover slot 211 and is fixedly connected with the face cover 210, and the second connecting part 124 is inserted into the bottom cover slot 221 and is fixedly connected with the bottom cover 220. In this way, during the use of the packaging box 20, the first connecting piece 110 can be driven to rotate relative to the second connecting piece 120 by lifting the face cover 210 to open the face cover 210. After the face cover 210 and the bottom cover 220 are assembled through the hinge structure 10, the face cover 210 can be opened at multiple angles, and it is convenient to fix the opening angle of the face cover 210. The problem that the cover 210 rotates and damages the user is avoided, and the convenience of unpacking and taking things from the packaging box 20 is improved.

In the hinge structure and the packaging box provided by the present application, by the limiting slot arranged in the slot and the clipping strip arranged on the rotating shaft which is matched with the limiting slot, when the rotating shaft of the second connecting piece is inserted into the slot and the second connecting piece or/and the first connecting piece are subjected to an external deflection force, causing the first connecting piece to rotate relative to the second connecting piece, clipping strip slides along the inner wall of the slot until it is embedded in the limiting slot. In this way, the clipping strip is not easy to fall off from the limiting slot under the restriction of the limiting slot, so as to fix the relative rotation angle between the first connecting piece and the second connecting piece. On the contrary, when it is necessary to change the relative position of two objects connected through the hinge structure, only the first connecting piece or/and the second connecting piece only needs to be buckled with force from the opposite side, that is, the clipping strip leaves from the limiting slot, so as to facilitate the relative rotation of the first connecting piece and second connecting piece to adjust the relative rotation angle between them. The hinge structure involves few parts and has a simple structure. The relative rotation angle between the first connecting piece and the second connecting piece can be fixed, so as to avoid the damage of the connecting piece or the failure of the hinge structure caused by the excessively large relative rotation angle, so as to improve the market competitiveness of the hinge structure.

The technical features of the above embodiments can be combined arbitrarily. In order to make the description concise, all possible combinations of the technical features in the above embodiments are not described. However, as long as there is no contradiction in the combination of these technical features, they shall be considered to be the scope recorded in this specification.

The above embodiments only express several embodiments of the present application, and the description is more specific and detailed, but it cannot be understood as a limitation on the scope of the patent of the present application. It should be noted that for ordinary technicians in the art, several deformations and improvements can be made without departing from the concept of the present application, which belong to the protection scope of the present application. Therefore, the scope of protection of the present application patent shall be subject to the appended claims.

What is claimed is:

1. A hinge structure, wherein, comprises a first connecting piece provided with a slot and a second connecting piece provided with a rotating shaft that matches with the slot, the second connecting piece rotates relative to the first connecting piece when the rotating shaft is inserted into the slot and subjected to external force;

an inner wall of the slot is provided with a limiting slot and an outer surface of the rotating shaft is convex to form a clipping strip; the clipping strip is inserted into the limiting slot to limit a relative rotation angle between the first connecting piece and the second connecting piece when the rotating shaft is inserted into the slot and rotates relative to the first connecting piece;

an outer surface contour of the clipping strip matches with an inner surface contour of the limiting slot;

the limiting slot extends along a depth direction of the slot, and the clipping strip extends along a length direction of the rotating shaft;

the outer surface of the rotating shaft is provided with two clipping strips in parallel, the inner wall of the slot is provided with at least one set of limiting slots, and each set of the limiting slots comprises two limiting slots which are matched with the two clipping strips one by one;

the first connecting piece comprises a first connecting column provided with the slot and a first connecting part integrally formed with an outer surface of the first connecting column;

the second connecting piece comprises a second connecting column and a second connecting part integrally formed with an outer surface of the second connecting column, the rotating shaft is arranged in the middle of the second connecting column along an axial direction of the second connecting column;

an end face of the first connecting column protrudes at an edge of the slot to form a first sector-annular convex portion, an end face of the second connecting column is recessed to form a second sector-annular recessed portion half surrounding the rotating shaft; when the rotating shaft is inserted into the slot the first sector-annular convex portion is inserted into the second sector-annular recessed portion, and can rotate in the second sector-annular recessed portion to limit a rotation angle range between the first connecting piece and the second connecting piece.

2. The hinge structure according to claim 1, wherein, the first connecting part is provided with a first recessed portion that is rotatably matched with the outer surface of the second connecting column, and the second connecting part is provided with a second recessed portion that is rotatably matched with the outer surface of the first connecting column.

3. The hinge structure according to claim 1, wherein, a circumferential angle corresponding to the first sector-annular convex portion is between 90° and 120°, and a circumferential angle corresponding to the second sector-annular recessed portion is between 180° and 270°.

4. A packaging box, wherein, comprises the hinge structure according to claim 1, the packaging box further comprises a face cover and a bottom cover, and the face cover is connected with the bottom cover through the hinge structure.

5. The packaging box according to claim 4, wherein, the face cover is provided with a face cover slot, the bottom cover is provided with a bottom cover slot; the first connecting part is inserted into the face cover slot and is fixedly connected with the face cover, and the second connecting part is inserted into the bottom cover slot and is fixedly connected with the bottom cover.

* * * * *